US009435183B2

(12) United States Patent
Chung

(10) Patent No.: US 9,435,183 B2
(45) Date of Patent: Sep. 6, 2016

(54) STEAM ENVIRONMENTALLY GENERATED DRAINAGE SYSTEM AND METHOD

(71) Applicant: Bernard Compton Chung, Calgary (CA)

(72) Inventor: Bernard Compton Chung, Calgary (CA)

( * ) Notice: Subject to any disclaimer, the term of this patent is extended or adjusted under 35 U.S.C. 154(b) by 114 days.

(21) Appl. No.: 14/153,202

(22) Filed: Jan. 13, 2014

(65) Prior Publication Data

US 2015/0198026 A1 Jul. 16, 2015

(51) Int. Cl.

| | |
|---|---|
| ***E21B 43/24*** | (2006.01) |
| ***E21B 43/243*** | (2006.01) |
| ***E21B 33/12*** | (2006.01) |
| ***E21B 36/02*** | (2006.01) |
| ***E21B 41/00*** | (2006.01) |
| ***E21B 17/04*** | (2006.01) |
| ***E21B 17/042*** | (2006.01) |

(52) U.S. Cl.

CPC ..... *E21B 43/2408* (2013.01); *E21B 17/04* (2013.01); *E21B 17/042* (2013.01); *E21B 33/12* (2013.01); *E21B 36/02* (2013.01); *E21B 41/0078* (2013.01); *E21B 43/243* (2013.01)

(58) Field of Classification Search

CPC ..... E21B 36/02; E21B 43/16; E21B 43/20; E21B 43/2406; E21B 43/2408; E21B 43/243; F23D 14/58

See application file for complete search history.

(56) References Cited

U.S. PATENT DOCUMENTS

| | | | | |
|---|---|---|---|---|
| 3,372,754 | A * | 3/1968 | McDonald | E21B 36/02 166/261 |
| 3,467,191 | A | 9/1969 | Van Daalen et al. | |
| 4,495,994 | A | 1/1985 | Brown | |
| 5,142,608 | A | 8/1992 | Meshekow | |
| 5,826,422 | A * | 10/1998 | Koyama | B01B 1/005 422/177 |
| 6,446,726 | B1 | 9/2002 | Grundmann | |
| 7,516,789 | B2 | 4/2009 | Chhina | |
| 7,770,646 | B2 * | 8/2010 | Klassen | E21B 43/164 166/303 |
| 7,841,408 | B2 | 11/2010 | Vinegar | |
| 7,849,922 | B2 | 12/2010 | Vinegar | |
| 7,866,386 | B2 | 1/2011 | Beer | |
| 8,091,626 | B1 | 1/2012 | Hill | |
| 8,191,630 | B2 | 6/2012 | Stegemeier | |
| 8,333,239 | B2 | 12/2012 | Schneider | |
| 8,353,342 | B2 | 1/2013 | Latimer | |
| 2009/0260811 | A1 * | 10/2009 | Cui | E21B 36/02 166/272.3 |

(Continued)

FOREIGN PATENT DOCUMENTS

| | | |
|---|---|---|
| CA | 1214722 A1 | 12/1986 |
| CA | 2770811 A1 | 8/2013 |

(Continued)

*Primary Examiner* — Robert E Fuller
*Assistant Examiner* — Christopher Sebesta
(74) *Attorney, Agent, or Firm* — David Guerra

(57) ABSTRACT

A steam environmentally generated drainage system and method for producing hydrocarbons from a formation using in situ steam generation and gravity drainage. The system and method includes a first well as a circulation and production well, a second well as a circulation, injection and combustion well, and a third well as an injection well. The second well is configurable to have a fuel tubing, a gas tubing, and an igniter. The third tubing injects a vaporizable fluid into the formation so as to be vaporized by combustion gases created by the in situ combustion in the second well. Hydrocarbon fluids are produced from the first well and lifted to the surface for process. The third well can be configured to also produce combustion gases so as to control a gas chamber pressure of a gas chamber created by the rising combustion gases.

18 Claims, 9 Drawing Sheets

(56) References Cited

U.S. PATENT DOCUMENTS

| | | | | |
|---|---|---|---|---|
| 2010/0163229 | A1* | 7/2010 | Nenniger | E21B 43/2406 166/272.3 |
| 2010/0218946 | A1 | 9/2010 | Symington | |
| 2010/0258309 | A1 | 10/2010 | Ayodele | |
| 2011/0253363 | A1* | 10/2011 | Banerjee | E21B 43/2408 166/248 |
| 2012/0247773 | A1 | 10/2012 | Schneider | |
| 2013/0020076 | A1 | 1/2013 | Schneider | |
| 2013/0269935 | A1 | 10/2013 | Cao | |
| 2014/0076555 | A1* | 3/2014 | Kerr | E21B 43/2408 166/272.3 |
| 2015/0034313 | A1* | 2/2015 | Gittins | E21B 43/2408 166/261 |

FOREIGN PATENT DOCUMENTS

| | | | |
|---|---|---|---|
| GB | 985640 | A | 3/1965 |
| GB | 1168493 | A | 10/1969 |
| WO | 2013134864 | A1 | 9/2013 |

* cited by examiner

STEAM ENVIRONMENTALLY GENERATED DRAINAGE SYSTEM AND METHOD

BACKGROUND OF THE INVENTION

1. Field of the Invention

The present invention relates to a steam environmentally generated drainage system and method for use in connection with producing hydrocarbons from a formation or reservoir using in situ steam generation and gravity drainage.

2. Description of the Prior Art

The use of steam assisted gravity drainage (SAGD) systems is known in the prior art. Hydrocarbons obtained from subterranean formations are often used as energy resources, as feedstocks, and as consumer products. It is an important issue to develop more efficient recovery, processing and/or use of available hydrocarbon resources, while increasing safety to personnel and protecting the surrounding environment. In situ processes may be used to remove hydrocarbon materials, such as bitumen, from subterranean formations that were previously inaccessible and/or too expensive to extract using available methods. To efficiently and effectively extract hydrocarbon material from subterranean formations, the chemical and/or physical properties of the hydrocarbon material may need to be altered to allow the hydrocarbon material to be more easily flow through the formation. The systems and methods associated with these changes may include in situ reactions that produce removable fluids, composition changes, solubility changes, density changes, phase changes, and/or viscosity changes of the hydrocarbon material in the formation.

It is known that deposits of heavy hydrocarbons contained in relatively permeable formations (for example in oil sands) are found throughout the world, and these deposits can be surface-mined and upgraded to lighter hydrocarbons. Surface mining and upgrading oil sands is an expensive process with questionable environmental impact and human health safety.

Alternatively to surface mining, an in situ heat treatment process may be used to change the heavy hydrocarbons into a more mobile material for recovery. This in situ heat treatment process may include the use of vertical and/or substantially vertical wells, horizontal or substantially horizontal wells (such as J-shaped wells and/or L-shaped wells), and/or u-shaped wells are used to treat the formation and produce the mobile oil. In some embodiments, combinations of horizontal wells, vertical wells, and/or other combinations are used to treat the formation. In certain embodiments, wells extend through the overburden of the formation to a hydrocarbon containing layer of the formation. In some situations, heat in the wells is lost to the overburden. In additional situations, surface and overburden infrastructures used to support heaters and/or production equipment in horizontal wellbores or u-shaped wellbores are large in size and/or numerous.

The use of in situ heating using injected steam has raised questions towards the damages to the environment and the safety to the surrounding populations and personnel working on site. Currently, SAGD projects generate steam at surface using steam generators or boilers. These projects burn primarily natural gas to generate the steam and emit the combustion gases to the environment containing wasted heat, wasted water vapor, carbon dioxide, nitrogen oxides, sulfur oxides and other pollutants. Additional energy and steam are wasted in the equipment used to generate and transport the steam to the reservoir. They also must generate boiler quality feed water for steam generation. This requires significant amounts of make-up water and the disposal of wasted blowdown water. Consequently, by generating steam at surface, SAGD projects waste energy and water; emits carbon dioxides and other pollutants to the environment; and require significant amounts of capital and operating expenditures.

Therefore, a need exists for a new and improved steam environmentally generated drainage system and method that can be used for producing hydrocarbons from a formation using in situ steam generation and gravity drainage. In this regard, the present invention substantially fulfills this need. In this respect, the steam environmentally generated drainage system and method according to the present invention substantially departs from the conventional concepts and designs of the prior art, and in doing so provides an apparatus primarily developed for the purpose of producing hydrocarbons from a formation using in situ steam generation and gravity drainage.

SUMMARY OF THE INVENTION

In view of the foregoing disadvantages inherent in the known types of SAGD now present in the prior art, the present invention provides an improved steam environmentally generated drainage system and method, and overcomes the above-mentioned disadvantages and drawbacks of the prior art. As such, the general purpose of the present invention, which will be described subsequently in greater detail, is to provide a new and improved steam environmentally generated drainage system and method which has all the advantages of the prior art mentioned heretofore and many novel features that result in a steam environmentally generated drainage system and method which is not anticipated, rendered obvious, suggested, or even implied by the prior art, either alone or in any combination thereof.

To attain this, the present invention essentially comprises a first well as a circulation and production well, a second well as a circulation, injection and combustion well, and a third well as an injection well. The first, second and third wells being vertically displaced from each other in a hydrocarbon reservoir. The second well is configurable to create an in situ combustion by having a slotted liner defining a plurality of bores, and including therein an igniter, a fuel tubing, and a gas tubing. The fuel tubing and the gas tubing each has at least one port configured to deliver a flow into an interior of the slotted liner. The igniter is configured to ignite the flow from the fuel tubing and the gas tubing to create the in situ combustion within the slotted liner. The third well is configured to inject a vaporizing fluid into the hydrocarbon reservoir so that it is vaporized by the in situ combustion upon contact with combustion gases.

The third well can be configured to produce at least some of the combustion gas from a heel section of the third well, and to inject the vaporizable fluid into and along a remaining section of the third well.

There has thus been outlined, rather broadly, the more important features of the invention in order that the detailed description thereof that follows may be better understood and in order that the present contribution to the art may be better appreciated.

The invention may also include wherein the ports of the fuel tubing and gas tubing are a plurality of ports defined along a longitudinal axis of the fuel tubing and gas tubing respectively. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved steam environmentally generated drainage system and method that has all of the advantages of the prior art SAGD and none of the disadvantages.

It is another object of the present invention to provide a new and improved steam environmentally generated drainage system that may be easily and efficiently manufactured and marketed.

An even further object of the present invention is to provide a new and improved steam environmentally generated drainage system that has a low cost of manufacture with regard to both materials and labor, and which accordingly is then susceptible of low prices of sale to the consuming public, thereby making such steam environmentally generated drainage system economically available to the buying public.

Still another object of the present invention is to provide a new steam environmentally generated drainage system that provides in the apparatuses and methods of the prior art some of the advantages thereof, while simultaneously overcoming some of the disadvantages normally associated therewith.

Even still another object of the present invention is to provide a steam environmentally generated drainage system for producing hydrocarbons from a formation using in situ steam generation and gravity drainage. This allows for the production of hydrocarbon material from shallow formations while decreasing the probability of a blow out, and for using low pressure with high steam temperatures.

Lastly, it is an object of the present invention to provide a new and improved method for treating hydrocarbon formations using the steam environmentally generated drainage system. The method includes providing a first well, a second well and a third well in a hydrocarbon reservoir, wherein all three wells are vertically displaced from each other. Configuring the first and second wells as circulation wells for circulating a heated fluid therein. Injecting a mobilizing or heated fluid from the second well into the hydrocarbon reservoir, and after which configuring the first well as a production well. A fluid comprising at least some of the hydrocarbon material is then produced through the first well.

Then configuring the second well into a combustion well having a slotted liner defining a plurality of bores, an igniter, a fuel tubing, and a gas tubing, with the fuel tubing and the gas tubing each defining at least one port. Vaporizable fluid which could be comprised of produced water is then injected into the hydrocarbon reservoir from the third well.

After which, an in situ combustion is started by injecting a fuel from the fuel tubing into the slotted liner, and a gas containing oxygen from the gas tubing into the slotted liner. Then igniting the fuel and the gas using the igniter to create a combustion gas within the slotted liner. The combustion gas travels through the bores of the slotted liner and into the hydrocarbon reservoir.

The vaporizable fluid contacts the combustion gas and vaporizes so as to create a gas chamber toward the top of the hydrocarbon reservoir. Then a fluid comprising at least some of the hydrocarbon material is produced through the first well.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE INVENTION

Figure 1:
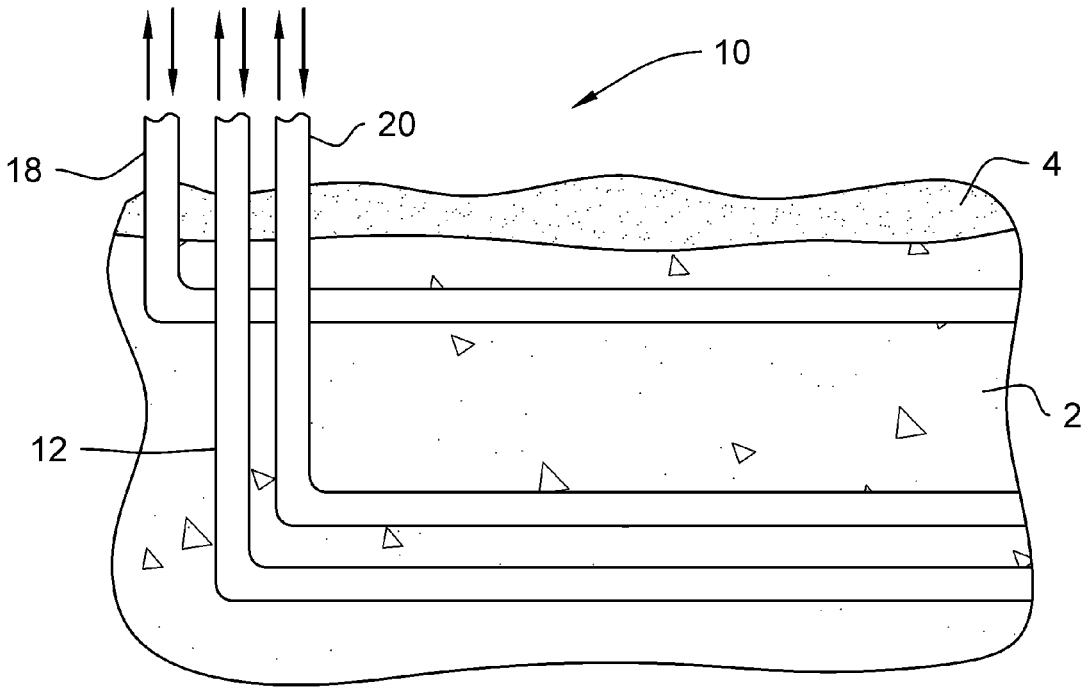
FIG. 1 is a schematic side view of an embodiment of the steam environmentally generated drainage system and method constructed in accordance with the principles of the present invention, with any arrowed lines depicting fluid flow.

Referring now to the drawings and particularly to FIGS. 1-20, an embodiment of the steam environmentally generated drainage (SEGD) system and method of the present invention is shown and generally designated by the reference numeral 10.

In FIG. 1, a new and improved SEGD system and method 10 of the present invention for producing hydrocarbons from a formation using in situ steam generation and gravity drainage is illustrated and will be described. More particularly, the SEGD system and method 10 can be used in removing, extracting or producing hydrocarbon material, such as but not limited to bitumen, from a subterranean formation or reservoir 2 that can include an overlying zone 4, such as but not limited to a gas zone, water zone or cap rock zone. The SEGD system and method 10 includes a multi-configurable production well 12, a multi-configurable water injection well 18 located above the production well 12 and near the overlying zone 4, and a multi-configurable combined steam injection and in situ combustion well 20 located between the production well 12 and water injection well 18. Exemplarily, the combined well 20 can be located near and above the production well 12. Alternatively, the production well 12 can also be used as a steam injection well, and the water injection well 18 can also be a carbon dioxide ($CO^2$) or combustion gas production well. The production well 12, the water injection well 18, and the combined well 20, each can include tubing strings, downhole systems and assemblies, and/or any means to contribute to their intended purpose.

It can be appreciated that the production well 12, water injection well 18 and combined well 20 can be vertical and/or substantially vertical wells, horizontal or substantially horizontal wells, J-shaped wells, L-shaped wells, U-shaped wells, and/or any combination thereof. For exemplarily purposes regarding the present application, the production well 12, water injection well 18 and combined well 20 are horizontal wells approximately vertically aligned and vertically displaced.

Figure 2:
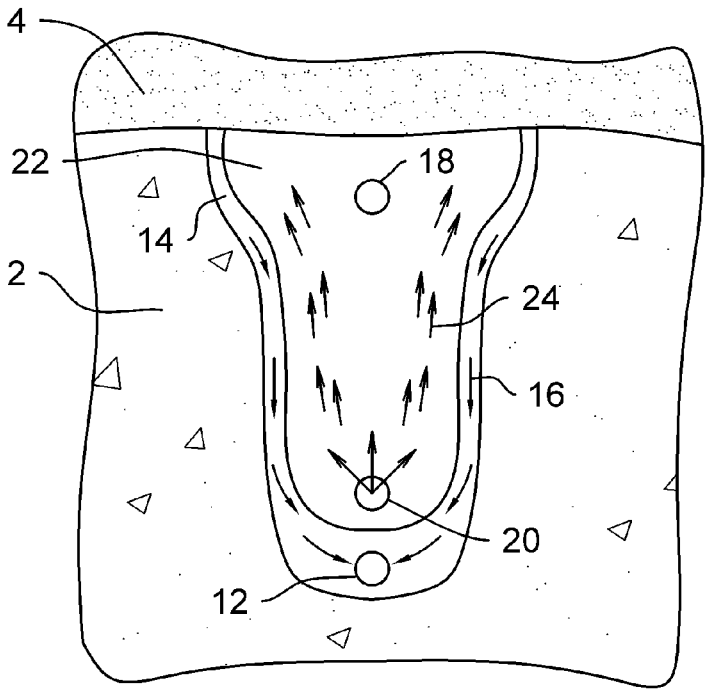
FIG. 2 is a schematic front view of the SAGD process using the steam environmentally generated drainage system of the present invention.
Figure 3:
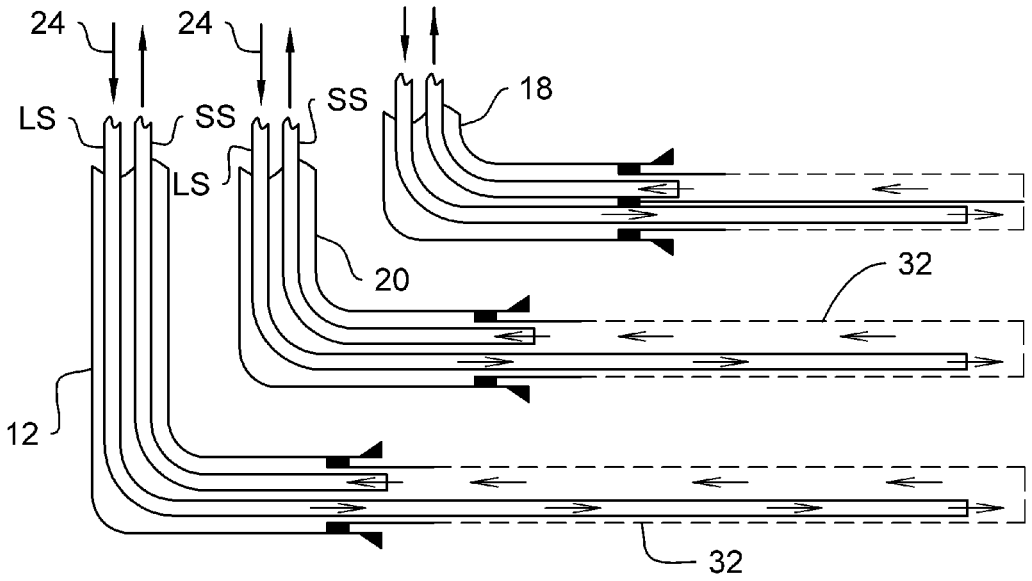
FIGS. 3 and 4 are schematic side views of the SAGD process using the steam environmentally generated drainage system of the present invention.

After the wells 12, 18, 20 have been drilled or formed, the SEGD system and method 10 initiates a SAGD process by circulating and/or injecting steam 24 into the reservoir 2 through the combined well 20 and/or the production well 12 until a steam chamber 22 eventually develops to the top of the reservoir 2, and a production boundary 14 is created adjacent the steam chamber 22, as best illustrated in FIG. 2. The steam 24 can be introduced into the production well 12 and/or combined wells 20 by way of a long string LS toward the toe of their respective well. Whereby the steam flows inside a slotted liner 32 from the toe of the production well 12 and/or combined wells 20 to a heel of the production well 12 and/or combined wells 20, as shown in FIG. 3.

A portion of the steam 24 can flow into the reservoir 2 through the slotted liner 32, and also back to the heel of the production well 12 and/or combined wells 20 to a short string SS which transfers the steam back to the surface, thereby creating a steam circulation loop. It can be appreciated that the steam 24 can be circulated in the production well 12 alone or in combination with the combined well 20, for a predetermined time period, for example 2-3 months. Thus heating the hydrocarbon material or bitumen between both the production and combined wells.

Figure 4:
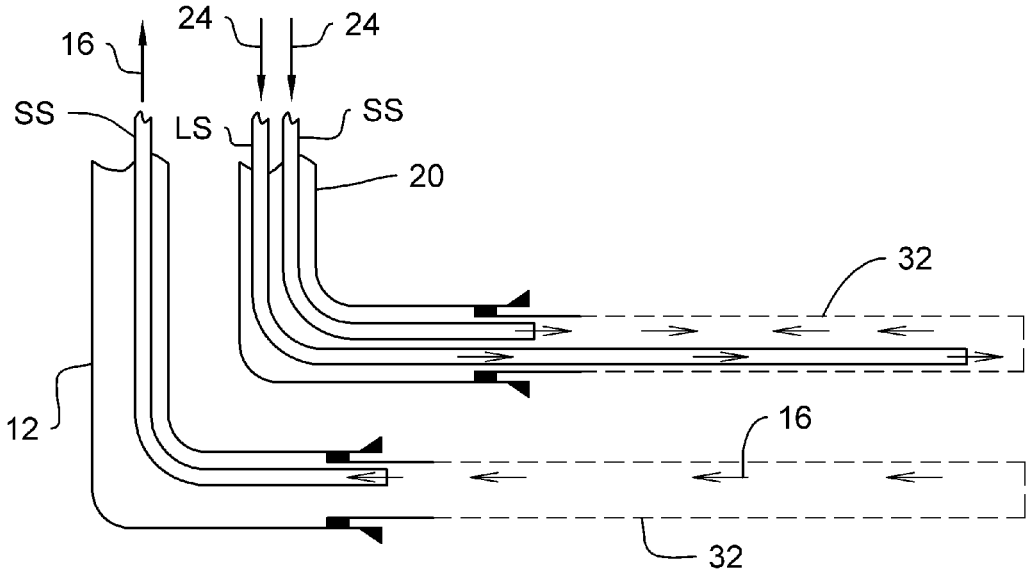

After the predetermined time period has lapsed, any steam injection through production well 12 is stopped, and the production well 12 is recompleted, as shown in FIG. 4. The long string LS of the production well 12 may be removed and a lifting mechanism (not shown), such as but not limited to, a downhole pump or gas lifting means, is placed downhole.

Steam 24 is then injected through the long string LS and short string SS of the combined well 20. The steam 24 flows out through the slotted liner 32 and into the surrounding reservoir 2, and thus consequently grows the steam chamber 22. Hot hydrocarbon fluids or bitumen emulsion 16 and steam condensate at the boundary 14 of the steam chamber 22 flows downward and towards the recompleted production well 12. The hot hydrocarbon fluids 16 are produced through the production well 12 and lifted to the surface via the lifting mechanism, while steam injection 24 is continued through the combined well 20. This SAGD process continues until the steam chamber 22 reaches the top of the reservoir 2 and/or until it reaches the overlying zone 4 as shown in FIG. 2, then all steam injection can be stopped.

Figure 5:
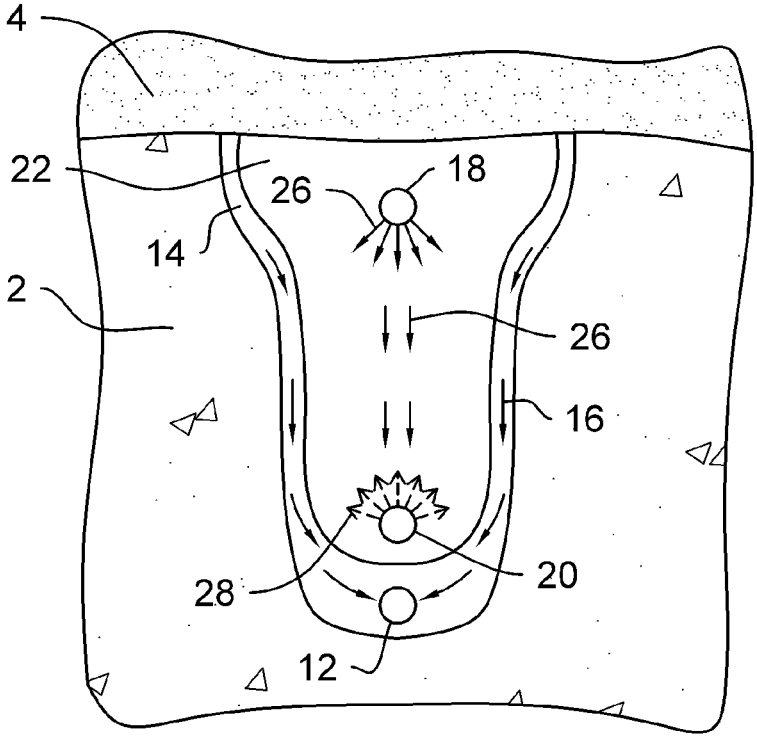
FIG. 5 is a schematic front view of in situ heating and water injection using the steam environmentally generated drainage system and method of the present invention.

After the SAGD process is finished the combined well 20 can be recompleted and converted to an in situ SEGD combustion well 20. Water 26 is injected into the top portion of the reservoir 2 through water injection well 18, and allowed to fall toward the combustion well 20 via gravity, as best illustrated in FIG. 5.

Figure 6:
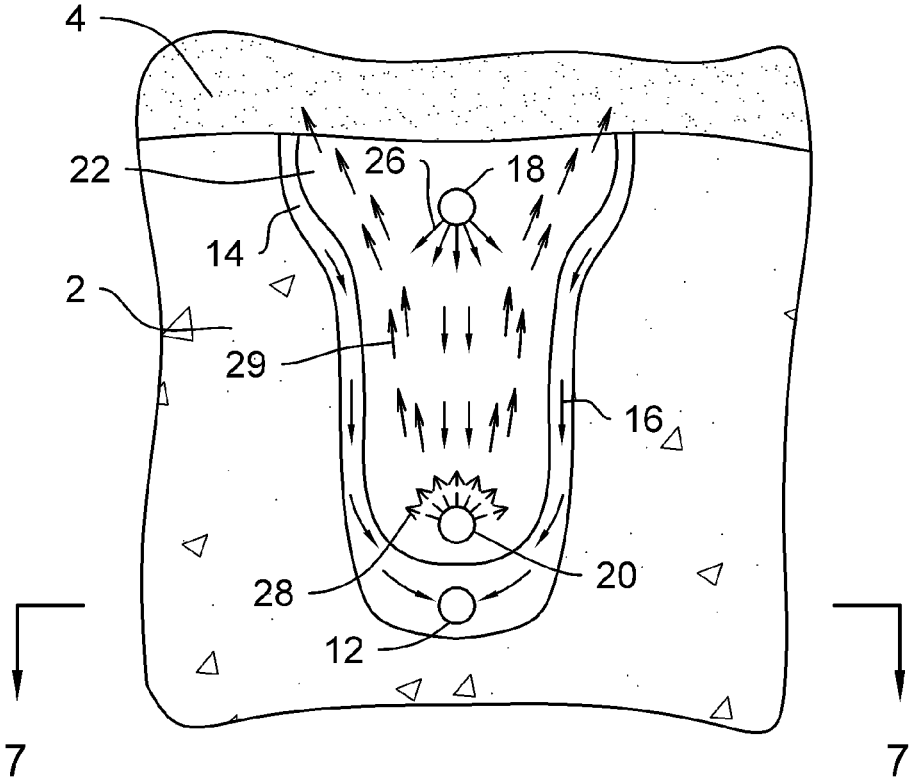
FIG. 6 is a schematic front view of in situ heating, water injection and in situ steam generation using the steam environmentally generated drainage system and method of the present invention.

In reference to FIG. 6, when the water front 26 approaches the combustion well 20, the SEGD process is initiated. Combustion gases are injected into the combustion well 20 to create an in situ combustion 28 configured for hydrocarbon production and to vaporize the injected water 26. When the water 26 contacts and mixes with the in situ combusted gases 28, the water 26 is vaporized and converted to steam 29 which rises to the top of the reservoir 2 to create a water, steam and $CO^2$ envelope. The steam 29 heats and reduces the viscosity of the surrounding hydrocarbon material 16. After a predetermined amount of time, the treated hydrocarbon material 16, and possible other fluids such as steam condensate, are mobilized and drain toward the production well 12, and are produced and lifted to the surface for further processing.

In the case that the overlying zone 4 is a gas or water zone, the $CO^2$ resulting from the in situ combustion can be sequestered into the gas or water zone 4. If zone 4 contains water, this water will gravity drain toward the combusted gases 28 and vaporize, thereby reducing the amount of required injected water 26.

In the case that the overlying zone 4 is a cap rock zone, then the water injection well 18 can be converted to also produce $CO^2$. Water injection can be stopped or can continue while producing $CO^2$ from converted water injection well 18. Simultaneous injection of water and production of $CO^2$ can occur by having 2 separate completions in well 18, a lower completion for water injection and an upper completion which could have a separate horizontal liner for $CO^2$ gas production. Excess $CO^2$ gas from the top of steam chamber 22 can be produced from converted water injection well 18 to maintain and control safe gas chamber pressure in the steam chamber 22. The control of gas chamber pressure can increase safety at the well site, and prevent blow outs of the well head and/or surrounding area above the reservoir 2. The control of gas chamber pressure can also allow hydrocarbon production from shallow formations, while reducing formation blow outs.

Figure 7:
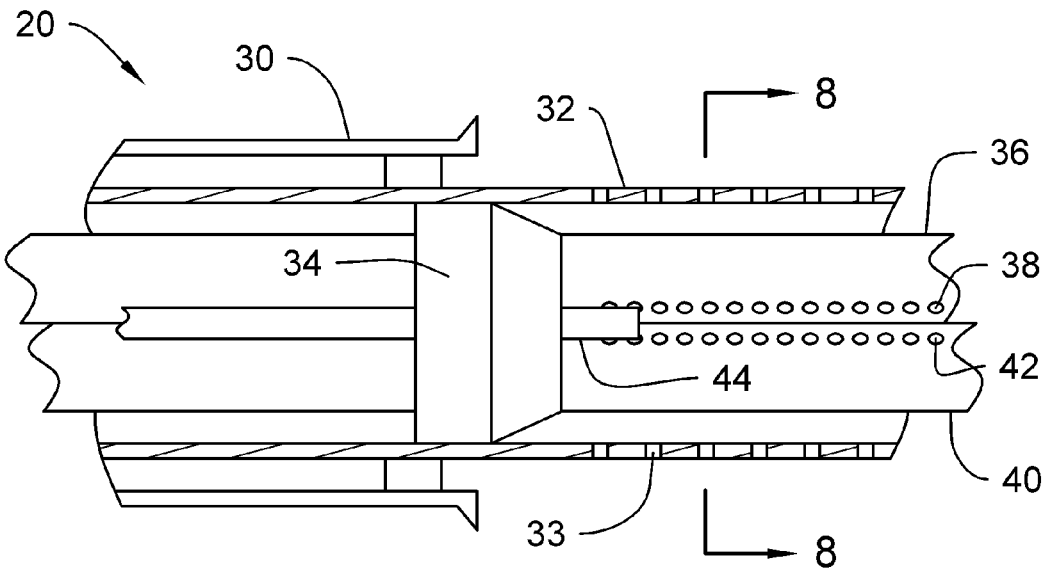
FIG. 7 is a cross-sectional view of the combined steam injection and combustion well of the present invention taken along line 7-7 in FIG. 6.
Figure 8:
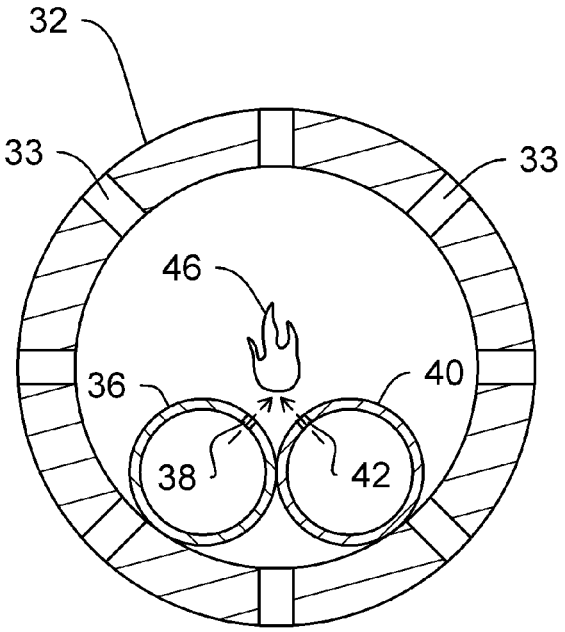
FIG. 8 is a cross-sectional view of the combined steam injection and combustion well of the present invention taken along line 8-8 in FIG. 7.

The combined steam injection and in situ combustion well 20, as best illustrated in FIGS. 7 and 8, includes a primary casing 30, a slotted liner 32 including a hanger, a flexible fuel tubing 36, a flexible air, oxygen or gas tubing 40, an igniter 44, and a combustor assembly packer 34. The combustor assembly packer 34 is configured to seal an area of the interior of the slotted liner 32 adjacent or upstream of the igniter 44, so that no combustion gases escape up the slotted liner 32 and/or into the combined well 20. The gas tubing 40 can be configured to deliver oxygen, air or any gas suitable for combustion in combination with a fuel delivered by the fuel tubing 36.

The slotted liner 32 features a plurality of radially defined bores 33 for the injection of steam during the SAGD process, and for exhausting combustion gases resulting from the in situ combustion into the surrounding reservoir 2 during the SEGD process. It can be appreciated that any number and configurations of the bores 33 can be used with the slotted liner 32. Furthermore, it can be appreciated that additional peripheral systems or devices, such as but not limited to, valves, sleeves, jets, plugs, and degradable or erodible materials can be associated with the bores 33.

The fuel tubing 36 features a plurality of fuel ports 38, and the gas tubing 40 features a plurality of gas ports 42. The fuel tubing 36 and gas tubing 40 may be located adjacent to each other with the fuel and gas ports 38, 42 angled toward each other so that their flows converge. It can further be appreciated that the fuel ports 38 and gas ports 42 can be a plurality of ports radially defined in the fuel tubing 36 and gas tubing 40, respectively, or can be oriented in any direction that allows their flows to contact and mix within the slotted liner 32. It can be appreciated that the fuel tubing 36 and gas tubing 40 can be welded together along a longitudinal axis, thereby creating a paired fuel and gas tubing. Still further, it can be appreciated that the fuel tubing 36 and gas tubing 40 may be located anywhere in the slotted liner 32 so as to allow the flows from the fuel and gas ports 38, 42 to contact and mix within the slotted liner 32.

The igniter 44 is located adjacent a heel of the combined well 20 and adjacent a point of convergence of the fuel and gas flows. The location of the igniter 44 provides ideal ignition of the fuel and gas flows to produce combustion or flame 46 within the slotted liner 32.

Figure 9:
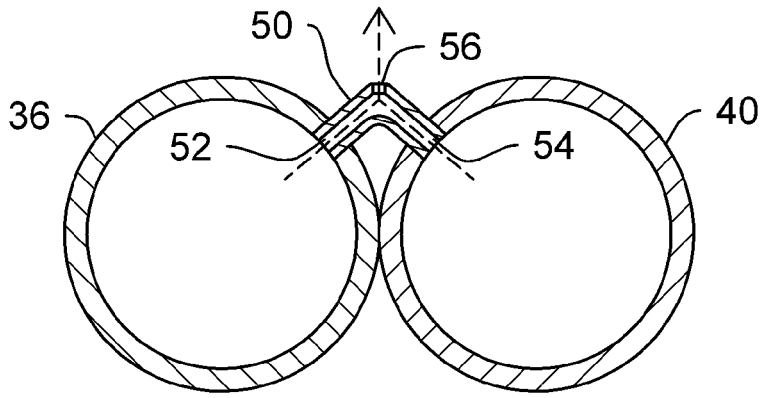
FIGS. 9-15 are cross-sectional views of alternate embodiment combustion nozzles associated with the fuel tubing and gas tubing of the combined steam injection and combustion well of the present invention.

Alternate embodiment nozzles associated with the fuel tubing 36 and gas tubing 40 are shown in FIGS. 9-15, and are described herewith. As best illustrated in FIG. 9, a first alternate embodiment nozzle 50 can be associated with the fuel and gas tubing 36, 40, and has a substantially inverted V-shaped configuration. The nozzle 50 has a fuel cylinder 52 received in or in communication with the fuel ports 38, a gas cylinder 54 received in or in communication with the gas ports 42, and an exit port 56 in communication with the hollow interiors of the fuel and gas cylinders 52, 54 and adjacent to an area where the fuel and gas flows converge, meet or mix. The exit port 56 is positioned so that the combined fuel and gas flows are directed vertically away from the fuel and gas tubing 36, 40 and toward the interior of the slotted liner.

It can be appreciated that the nozzle 50 can be a single nozzle unit associated with each fuel port and gas port pairing, or can be designed as a manifold which has a single main body featuring multiple exit ports 56, and/or multiple fuel and gas cylinders 52, 54 extending toward their corresponding fuel and gas ports.

Figure 10:
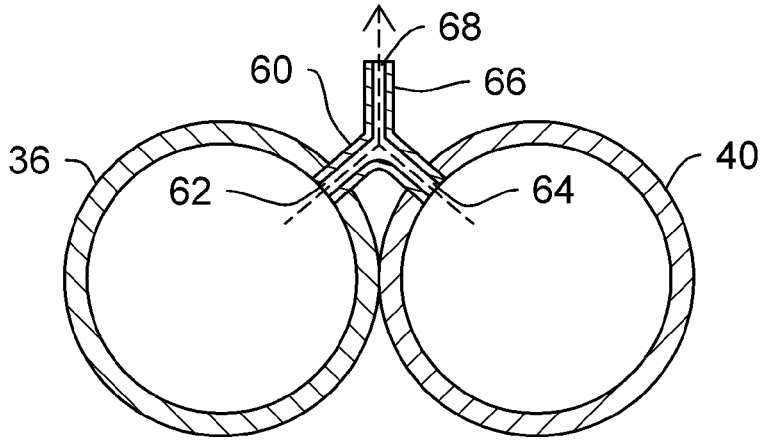

As best illustrated in FIG. 10, a second alternate embodiment nozzle 60 can be associated with the fuel and gas tubing 36, 40, and has a substantially inverted Y-shaped configuration. The nozzle 60 has a fuel cylinder 62 received in or in communication with the fuel ports 38, a gas cylinder 64 received in or in communication with the gas ports 42, and an exit cylinder 66 in communication with the hollow interiors of the fuel and gas cylinders 62, 64 and adjacent to an area where the fuel and gas flows converge, meet or mix. The exit cylinder 66 extends up from the fuel and gas cylinders 62, 64, and defines a passage 68 positioned so that the combined fuel and gas flows are directed vertically away from the fuel and gas tubing 36, 40 and toward the interior of the slotted liner 32.

It can be appreciated that the nozzle 60 can be a single nozzle unit associated with each fuel port and gas port pairing, or can be designed as a manifold which has a single main body featuring multiple exit cylinders, and/or multiple fuel and gas cylinders 62, 64 extending toward their corresponding fuel and air ports.

Figure 11:
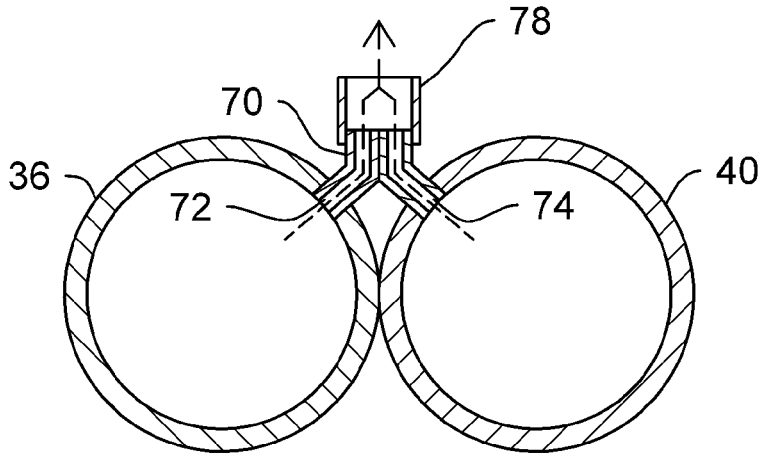

As best illustrated in FIG. 11, a third alternate embodiment nozzle 70 can be associated with the fuel and gas tubing 36, 40, and has a substantially inverted Y-shaped configuration. The nozzle 70 has a fuel cylinder 72, a gas cylinder 74, and an exit sleeve 78. The fuel cylinder 72 includes an input section received in or in communication with the fuel ports 38, and an exit section substantially vertical from the input section. The gas cylinder 74 includes an input section received in or in communication with the gas ports 42, and an exit section substantially vertical from the input section. The exit sections of the fuel and gas cylinders 72, 74 are parallel and adjacent to each other. The exit sleeve 78 has a substantially oval shape and is configured to receive the exit sections of the fuel and gas cylinders 72, 74 therein and to combine or mix the fuel and gas flows. The exit sleeve 78 extends vertically into the interior of slotted liner 32 thereby displacing the combustion away from the fuel and gas tubing 36, 40.

It can be appreciated that the nozzle 70 can be a single nozzle unit associated with each fuel port and air port pairing, or can be designed as a manifold which has a single main body featuring multiple exit cylinders, and/or multiple fuel and air cylinders extending toward their corresponding fuel and air ports.

Figure 12:
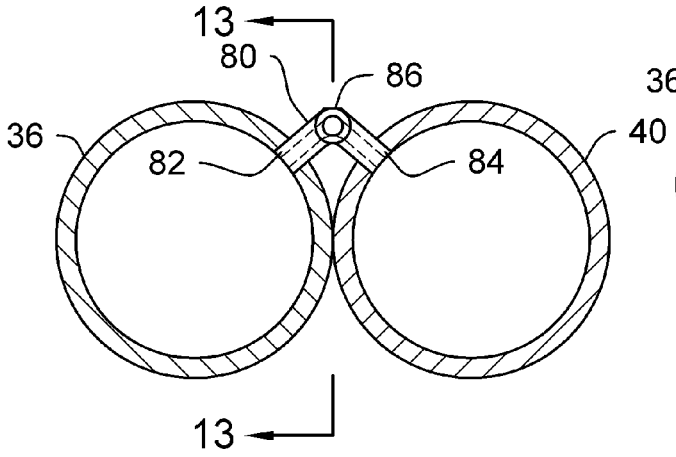
Figure 13:
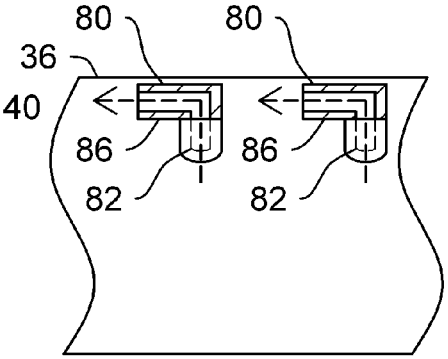

As best illustrated in FIGS. 12 and 13, a fourth alternate embodiment nozzle 80 can be associated with the fuel and gas tubing 36, 40, and is configured to produce a horizontal or substantially horizontal flame. The nozzle 80 has a fuel cylinder 82 received in or in communication with the fuel ports 38, a gas cylinder 84 received in or in communication with the gas ports 42, and an exit cylinder 86 extending horizontally away from an area where the fuel and gas cylinders 82, 84 converge. The exit cylinder 86 is in communication with the hollow interiors of the fuel and gas cylinders 82, 84 and adjacent to an area where the fuel and gas flows converge, meet or mix. The exit cylinder 86 extends parallel with the fuel and gas tubing 36, 40, and defines a passage positioned so that the combined fuel and gas flows are directed perpendicular from the fuel and gas cylinders 82, 84.

It can be appreciated that the nozzle 80 can be a single nozzle unit associated with each fuel port and gas port pairing, or can be designed as a manifold which has a single main body featuring multiple exit cylinders, and/or multiple fuel and gas cylinders extending toward their corresponding fuel and gas ports. It can further be appreciated that the nozzle 80 can be used with an exit port in place of the exit cylinder.

Figure 14:
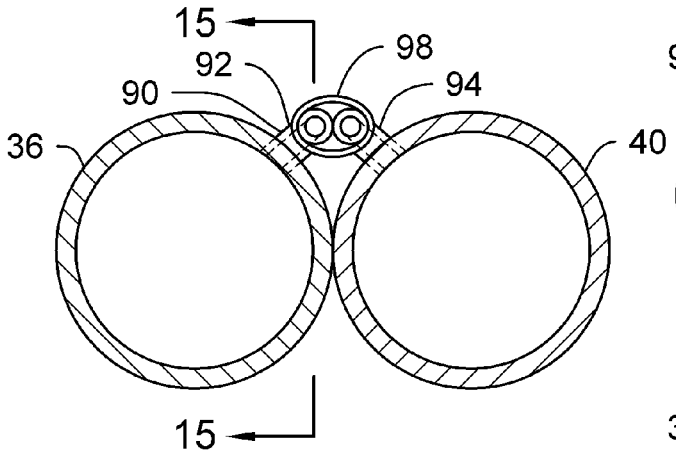
Figure 15:
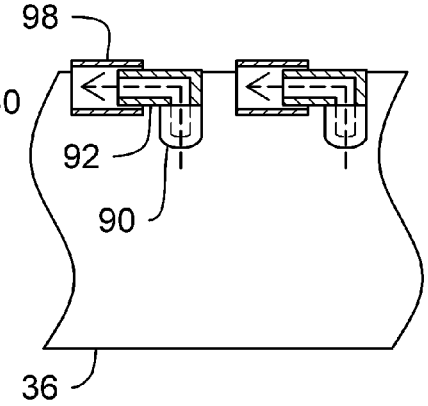

As best illustrated in FIGS. 14 and 15, a fifth alternate embodiment nozzle 90 can be associated with the fuel and gas tubing 36, 40, and is configured to produce a horizontal or substantially horizontal flame. The nozzle 90 has a fuel cylinder 92, a gas cylinder 94, and an exit sleeve 98. The fuel cylinder 92 includes an input section received in or in communication with the fuel ports 38, and an exit section extending parallel with the fuel tubing 36 and substantially perpendicular to the input section. The gas cylinder 94 includes an input section received in or in communication with the gas ports 42, and an exit section extending parallel with the gas tubing 40 and substantially perpendicular to the input section. The exit sections of the fuel and gas cylinders 92, 94 are parallel and adjacent to each other. The exit sleeve 98 has a substantially oval shape and is configured to receive the exit sections of the fuel and gas cylinders 92, 94 therein and to combine or mix the fuel and gas flows to produce a horizontally or substantially horizontally extending flame.

It can be appreciated that the nozzle 90 can be a single nozzle unit associated with each fuel port and gas port pairing, or can be designed as a manifold which has a single main body featuring multiple exit cylinders, and/or multiple fuel and gas cylinders extending toward their corresponding fuel and gas ports.

Figure 16:
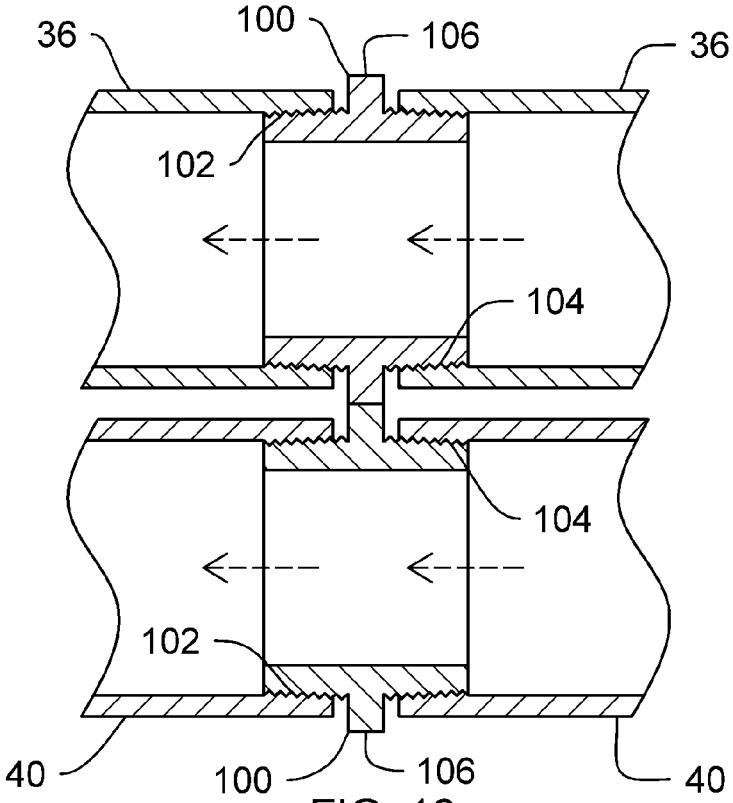
FIGS. 16-20 are cross-sectional views of alternate embodiment connection joints associated with the fuel tubing and gas tubing of the combined steam injection and combustion well of the present invention.

Alternate embodiment connection joints associated with sections of the fuel tubing 36 and gas tubing 40 are shown in FIGS. 16-20, and are described herewith. As best illustrated in FIG. 16, a first alternate embodiment connection joint 100 can be associated with joinable fuel tubing sections 36 and gas tubing sections 40 respectively. The connection joint 100 has a central interior passage, a pair of oppositely extending hollow members 102, 104 which defines the interior passage, and a flange 106 extending radially outward from a substantially central section of the connection joint 100 between the members 102, 104. The members 102, 104 each have exterior threads that are configured to have opposite rotational direction that correspond and engage with an internally threaded end of the fuel tubing sections 36 and/or the gas tubing sections 40. The oppositely rotational direction of the external threads allows a user to turn the flange so as to either tighten or loosen two fuel or gas tubing sections respectively.

It can be appreciated that the connection joint 100 can include seals or gaskets, and the profile of the flange 106 can be of any geometric shape so as to facilitate rotation of the connection joint 100 to engage with its corresponding fuel and/or gas tubing sections 36, 40 respectively. It can further be appreciated that the connection joint 100 can include sensors to detect leakage of flow from the fuel and/or gas tubing.

Figure 17:
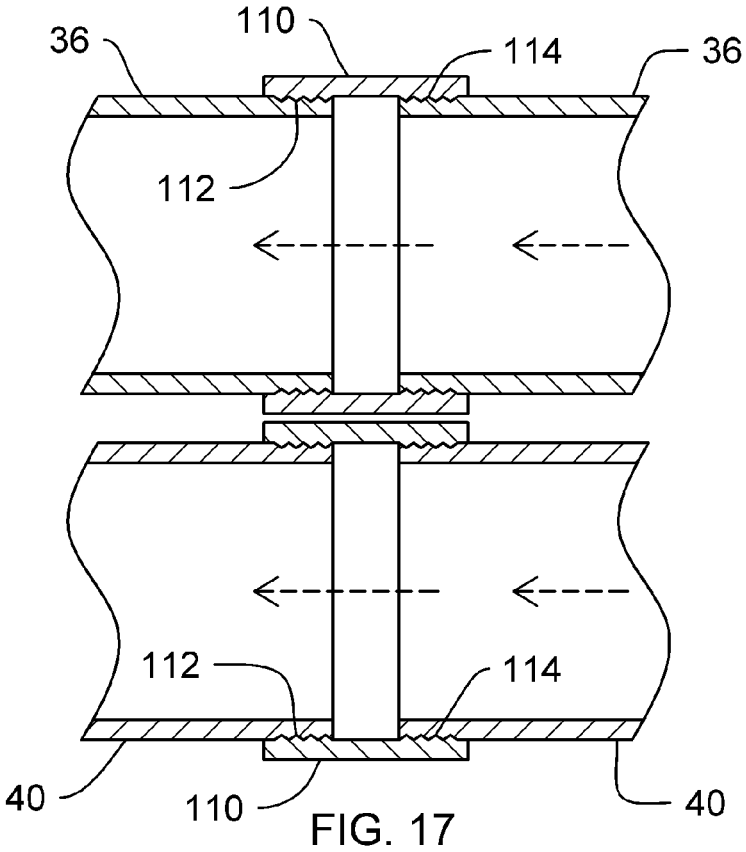

As best illustrated in FIG. 17, a second alternate embodiment connection joint 110 can be associated with joinable fuel tubing sections 36 and gas tubing sections 40 respectively. The connection joint 110 is a coupling sleeve having a central interior passage, a pair of opposite ends 112, 114 which defines the interior passage. The ends 112, 114 each have internal threads that are configured to have opposite rotational direction that correspond and engage with an externally threaded end of the fuel tubing sections 36 and/or the gas tubing sections 40. The oppositely rotational direction of the internal threaded ends 112, 114 allows a user to turn the connection joint 110 so as to either tighten or loosen two fuel or gas tubing sections respectively.

It can be appreciated that the connection joint 110 can include seals, gaskets, and/or and a flange extending radially outward from the connection joint 110. The flange can have a geometric profile so as to facilitate rotation of the connection joint 110 to engage with its corresponding fuel and/or gas tubing sections 36, 40 respectively. It can further be appreciated that the connection joint 110 can include sensors to detect leakage of flow from the fuel and/or gas tubing, and that the fuel tubing and gas tubing can be used with a combination of the first and second alternate embodiment connection joints 100, 110.

Figure 18:
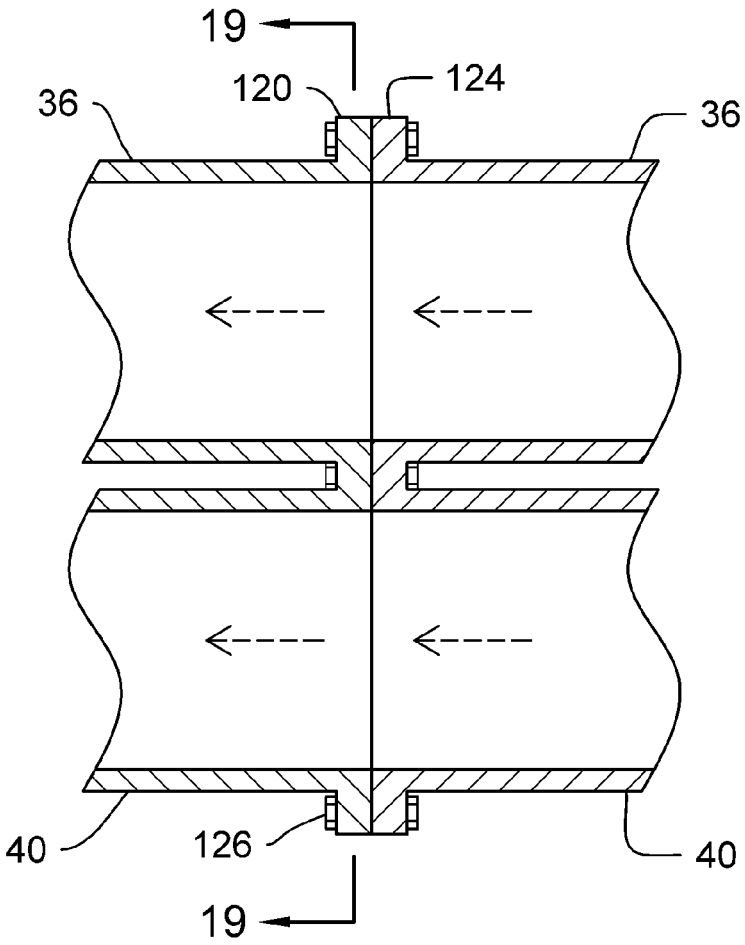
Figure 19:
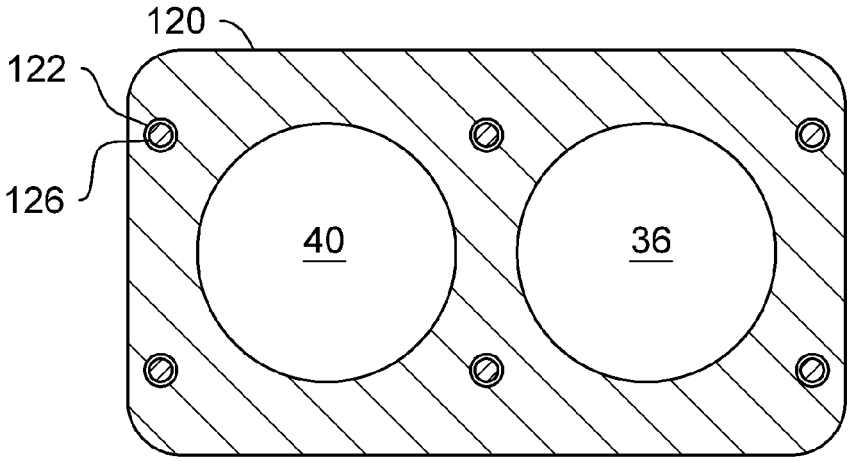

As best illustrated in FIGS. 18 and 19, a third alternate embodiment connection joint 120 can be associated with joinable fuel tubing sections 36 and gas tubing sections 40 respectively. The connection joint 120 is a flanged end plate fitted to the ends of a fuel tubing section 36 and a gas tubing section 40, thereby producing a paired fuel and gas tubing section featuring flanged end plates 120. The flanged end plate 120 includes a pair of passages therethrough each of which is associated with or in communication with a corresponding an end of a fuel tubing section 36 and an end of an gas tubing section 40. The flanged end plate 120 further includes a plurality of bores 122 therethrough configured to receive a fastener 126.

The flanged end plates 120 are configured to join and abut against an additional flanged end plates 124 of additional fuel and gas tubing sections 36, 40 so that their bores 122 are aligned, thereby allowing a fastener 126 to pass therethrough and secure the flanged end plates 120, 124 together. The bores 122 can be defined through the flanged end plates 120, 124 in a specific pattern so that joining end plates can only be secured together in a specific orientation, thereby prevent fuel tubing sections to be in communication with gas tubing sections.

It can be appreciated that the flanged end plate 120 can include seals, gaskets, internal threaded sections, and/or sensors to detect leakage of flow from the fuel and/or gas tubing.

Figure 20:
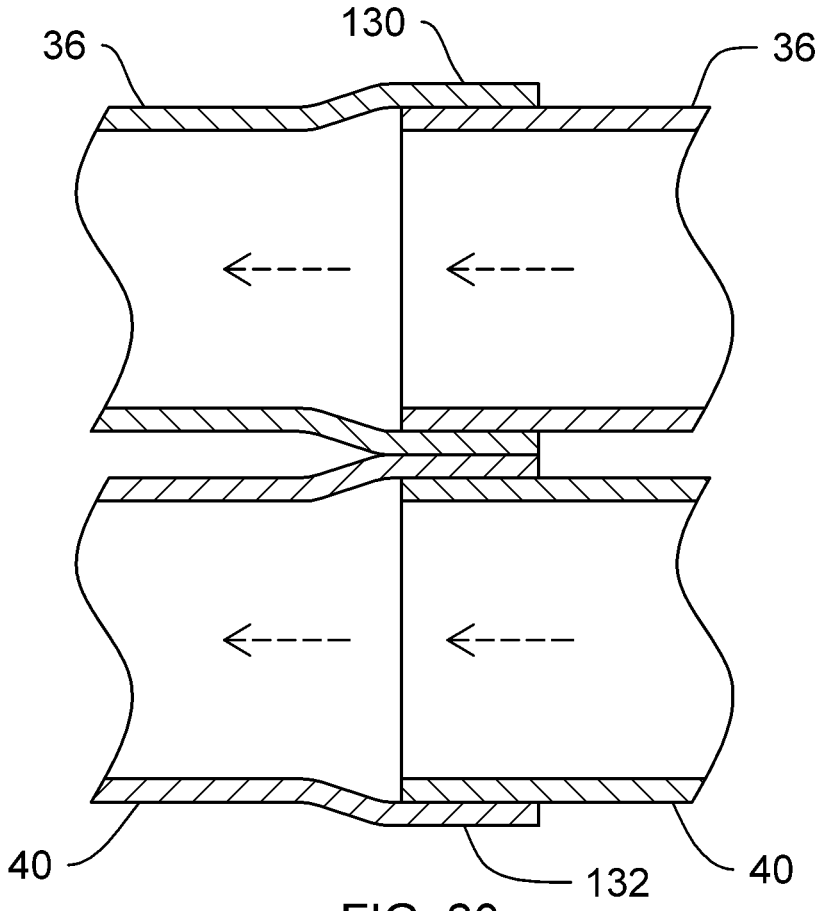

As best illustrated in FIG. 20, a fourth alternate embodiment connection joint 130, 132 can be associated with joinable fuel tubing sections 36 and gas tubing sections 40 respectively. The connection joint 130 is an enlarged or flared end of a fuel tubing section 36, and the connection joint 132 is an enlarged or flared end of a gas tubing section 40. The flared end 130 of the fuel tubing section 36 is configured to receive a non-flared end of another fuel tubing section 36, and the flared end 132 of the gas tubing section 40 is configured to receive a non-flared end of another gas tubing section 40. The flared ends 130, 132 can be, but not limited to, welded, glued, threaded, mechanically fitted, shrink fitted or press fitted to its corresponding non-flared end It can be appreciated that the connection joint 130, 132 can include seals, gaskets, threaded sections, and/or sensors to detect leakage of flow from the fuel and/or gas tubing.

It can be further appreciated that combined well 20 could have different combinations of nozzles 50, 60, 70, 80, 90, especially the vertical and horizontal flame types. Horizontal flame types may be required to ignite the fuel and/or gas from one port to the other port across the joints 100, 110, 120, 124, 130, 132 where the distance between ports may be larger or for other reasons.

In use, it can now be understood that SEGD process and system, used in combination with a modified SAGD process, can result in higher hydrocarbon production yield with increased efficiency and safety and minimum environmental impact. With respect to the above described SAGD process, after the production well 12, the water injection well 18, and the combined well 20 have been drilled or formed; the following exemplary SEGD process or method can be implemented.

A steam chamber 22 is created from the combined well 20 to the top of reservoir 2. Produced water 26 can be filtered and injected into the top portion of reservoir 2 through the water injection well 18 at a temperature at or lower than the steam chamber temperature. The water 26 drains downward toward the combined well 20 by way of gravity.

For example, but limiting to, natural gas in combination with oxygen or air are injected into the combined well 20 through fuel tubing 36 and gas tubing 40 respectively. Combustion of the natural gas and air ensues downhole inside the slotted liner 32 via the igniter 44, thereby converting the combined well 20 into a burner.

Consequently, combustion gases 28 (steam and $CO^2$) flow into the reservoir 2 and rises upwardly due to the buoyancy toward the draining water 26. The draining water 26 vaporizes into steam 29 when it contacts and mixes with the combustion gases produced by the combined well 20.

The combined combustion gases 28 and steam 29 flow upwards and sideways toward the sides of the chamber 22 converting the initial steam chamber into a combined steam and combustion gas chamber (steam/gas chamber 22). The hydrocarbon material or bitumen at the sides of the chamber 22 is heated by the steam/gas chamber 22 causing the steam to condense and some $CO^2$ to dissolve into the heated bitumen.

The heated bitumen including some dissolved $CO^2$ is mobilized toward the production well 12, and then lifted to the surface for processing. Additionally, the connate water and the steam condensate are drained to the production well 12 by way of gravity, and are lifted to the surface for processing.

In the case the reservoir 2 is entirely a bitumen reservoir; the $CO^2$ can be produced from the top of the reservoir to maintain a predetermined and/or approved safe steam chamber pressure. The produced $CO^2$ can be conditioned for sequestration, possibly dehydration and liquefaction.

The required energy (net) is estimated as the sum of the vaporization energy of the injected water 26, plus any water drained from zone 4.

During and after the SEGD process, produced fluids from the production well 12 which are lifted to the surface are then pipelined to a processing plant. The produced fluid can be degassed and the produced liquid is transferred to the free water knock out. The produced free water can be separated out in the free water knock out and is transferred to the produced water tank.

A treater breaks the produced emulsion to produce pipeline specification bitumen that is blended with diluent. The separated, produced water can be transferred from the treater to the produced water tank. Produced water can then be transferred from the produced water tank to the water injection wells 18 at the well pads. If needed, the produced water can be filtered at the exit discharge from the produced water tank and preheated using heat exchangers with hot produced fluids.

Natural gas and oxygen or air can be pipelined in separate pipelines to the well pads and then to the combined well 20. If oxygen is used, an oxygen plant that produces oxygen from the atmosphere can be used. If $CO^2$ gas is removed or produced from the steam chamber via the water injection well 18, then the produced $CO^2$ gas can be dehydrated and liquefied for sequestration into an abandoned SAGD or SEGD chamber, or into an aquifer.

There are many advantages of the SEGD process and system of the present invention over the known SAGD processes. The SEGD process of the present invention has higher energy efficiency by way of direct combustion and heating of the steam chamber, with no heat losses and steam losses in flue gases and in all surface equipment. The emissions are reduced with $CO^2$ gas sequestration, and no combustion emissions of $CO^2$, CO, NOx and/or SOx.

The SEGD process of the present invention has less to no make-up water, and has negligible to no disposed water. Water treatment is less complex and cost effective, and may require only filtration. For steam generation, the SEGD process of the present invention does need or use surface boilers or once through steam generators but only for a short initial period to create a small steam chamber to the top of the reservoir.

The production rate of the SEGD process of the present invention is expected to be higher due to higher quality and higher temperature steaming, and some viscosity reduction from $CO^2$ solvent effect. Oil recovery is expected to be higher with top gas or water zone, comparable to other similar top zone formations. The steam oil ratio and fuel consumption are expected to be significantly lower.

The capital costs are expected to be lower due to significant reduction in plant costs and steam lines offset by costs of the horizontal water injection well and the downhole in situ combustion well or burner. The operating costs are expected to be lower due to the lower energy requirement as illustrated in Table 1, less water treatment, no steam generation at the surface and lower facility maintenance costs.

TABLE 1

Example of Energy Requirement for SEGD Production - U.S. Units

| | Vol., b | Mass, lb | Heat, mbtu/lb | Energy, mbtu | Energy, MJ |
|---|---|---|---|---|---|
| Recov. Oil | 1.0 | 355 | 0.5 | 63.9 | 67.4 |
| Res. Oil | 0.1 | 35 | 0.5 | 6.4 | 6.7 |
| Con. Water | 0.3 | 105 | 1.022 | 38.6 | 40.7 |
| Rock | 2.8 | 2449 | 0.24 | 211.6 | 223.2 |
| Subtotal | 4.2 | 2944 | 0.109 | 320.5 | 338.1 |
| Hot Gas VR | 1.3 | 4.4 | 1202 | 5.3 | 5.6 |
| Overburden | | | | 170 | 179 |
| Reservoir | | | | 134 | 141 |
| Total | | | | 630 | 664 |

The above energy requirement example based on extracting 1 b of oil was estimated using a reservoir temperature of 50° F. (10° C.), and a SAGD temperature of 410° F. (210° C.).

In reference to the original reservoir: the total volume is 4.2 b; the recovered oil (Recov. Oil) is 1 b, the residual oil (Res. Oil) is 0.1 b; the connate water (Con. Water) is 0.3 b; and the rock volume (Rock) is 2.8 b.

After reservoir extraction: the total volume is 4.2 b; the residual oil is 0.1 b; the rock volume is 2.5 b; and the hot gases (Hot Gas VR) is 1.3 b. The net extracted volumes are estimated to be: the production volume is 1.3 b; the production oil is 1.0 b; and the production water is 0.3 b.

With reference to the above example, an example of combustion volumes for the SEGD production of the present invention can be estimated. Using 630 mbtu as the energy required to produce 1 b of oil, then injection gases would be: 700 mscf of methane; and 1400 mscf of O2.

Combustion generates 700 mbtu gross energy or 630 mbtu of net energy. Combustion products are steam and $CO^2$ (reaction: $CH4+2O2 \rightarrow 2H2O+CO2$). The gaseous volumes are: 1400 mscf of H2O; and 700 mscf of CO2. With masses of: 66.5 lbm of H2O; and 81.2 lbm of CO2. Liquid water is 0.19 b.

The following CO2 volumes at different conditions can then be estimated at:

Hot reservoir (200° C., 2000 kPaa)–9.8 b;

Cold reservoir (10° C., 2000 kPaa)–5.1 b;

Liquid CO2 (16° C., 5200 kPaa)–0.27 b; and

Liquid CO2 (10° C., 4500 kPaa)–0.26 b.

The CO2 can be stored as a liquid in the SEGD reservoir or in a nearby formation at the CO2 liquid pressure and temperature.

It can be appreciated that any liquid or gas fuel source can be used in the fuel tubing, and even solids fuels, such as but not limited to, pulverized solid fuels, asphaltenes or coke packed in a cylindrical shape along with the oxygen supply line. After combustion, the ash is washed out and a new solid fuel pack with the oxygen supply line can be used.

While embodiments of the steam environmentally generated drainage system and method have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material for use in subterranean formations may be used. And although producing hydrocarbons from a formation using in situ steam generation and gravity drainage have been described, it should be appreciated that the steam environmentally generated drainage system and method herein described is also suitable for changing the physical and/or chemical characteristics of a material in a subterranean formation.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A steam environmentally generated drainage system for producing hydrocarbons from a formation using in situ steam generation and gravity drainage, said steam environmentally generated drainage system comprising:

a first well located in a hydrocarbon reservoir, said first well being configurable to produce treated fluids from the hydrocarbon reservoir;

a second well located in the hydrocarbon reservoir vertically displaced from said first well, said second well being configurable to circulate a heated fluid therein, to inject a heated fluid into the hydrocarbon reservoir, and to create an in situ combustion by having a slotted liner defining a plurality of bores, an igniter located in said slotted liner, a fuel tubing located in said slotted liner, and an oxidant tubing located in said slotted liner, said fuel tubing and said oxidant tubing each defining at least one port configured to deliver a flow into an interior of said slotted liner, said igniter being configured to ignite said flow from said fuel tubing and said oxidant tubing to create said in situ combustion within said slotted liner; and a third well located in the hydrocarbon reservoir vertically displaced from said second well, said third well having a configuration to inject a vaporizable fluid into the hydrocarbon reservoir;

wherein said port of said fuel tubing being a plurality of ports defined along a longitudinal axis of said fuel tubing, and said port of said oxidant tubing being a plurality of ports defined along a longitudinal axis of said oxidant tubing.

2. The steam environmentally generated drainage system according to claim 1, wherein said first well being further configurable to circulate said heated fluid therein.

3. The steam environmentally generated drainage system according to claim 2, wherein said igniter is located at a heel of said second well, and aligned with an area between said fuel tubing and said oxidant tubing.

4. The steam environmentally generated drainage system according to claim 2, wherein said port of said fuel tubing and said port of said oxidant tubing are angled toward each other so that said flow from said fuel tubing and said flow from said oxidant tubing make contact within said interior of said slotted liner.

5. The steam environmentally generated drainage system according to claim 4, wherein said bores of said slotted liner are configured to deliver combustion gases from said interior of said slotted liner created by said in situ combustion to an area of the reservoir surrounding said second well.

6. The steam environmentally generated drainage system according to claim 5, wherein said second well further comprising a combustor assembly packer configured to seal an area of said interior of said slotted liner adjacent said igniter.

7. The steam environmentally generated drainage system according to claim 2, wherein said fuel tubing is a plurality of fuel tubing sections fitted together by a fuel tubing connection joint, and said oxidant tubing is a plurality of oxidant tubing sections fitted together by an oxidant tubing connection joint.

8. The steam according to claim 2, wherein said third well is configured to produce at least some of said combustion gas from a heel section of said third well, and to inject said vaporizable fluid into and along a remaining section of said third well.

9. A method for treating hydrocarbon formations using a steam environmentally generated drainage system, said method comprising the steps of:

a) providing a first well in a hydrocarbon reservoir, a second well in the hydrocarbon reservoir vertically displaced from said first well, and a third well in the hydrocarbon reservoir vertically displaced from said second well;

b) configuring said first well and said second well each as a circulation well respectively, and circulating a heated fluid in said first and second wells;

c) injecting said heated fluid from said second well into the hydrocarbon reservoir;

d) configuring said first well as a production well;

e) configuring said second well into a combustion well having a slotted liner defining a plurality of bores, an igniter located in said slotted liner, a fuel tubing located in said slotted liner, and a oxidant tubing located in said slotted liner, said fuel tubing and said oxidant tubing each defining a plurality of ports defined along a longitudinal axis of said fuel tubing and said oxidant tubing, respectively;

f) injecting a vaporizable fluid into the hydrocarbon reservoir from said third well;

g) injecting a fuel from said fuel tubing into said slotted liner, injecting an oxidant from said oxidant tubing into said slotted liner, and igniting said fuel and said oxidant using said igniter to create a combustion gas within said slotted liner;

h) vaporizing said vaporizable fluid with said combustion gas; and i) producing said fluid comprising at least some of the hydrocarbon material from said first well.

10. The method according to claim 9, wherein said heated fluid is injected to form a fluid chamber in the hydrocarbon reservoir, and said injecting of said heated fluid is stopped when said fluid chamber reaches a top of the hydrocarbon reservoir.

11. The method according to claim 9, wherein said ports port of said fuel tubing and said ports port of said oxidant tubing are angled toward each other so that said fuel from said fuel tubing and said oxidant from said oxidant tubing make contact within an interior of said slotted liner.

12. The method according to claim 11, wherein said slotted liner has a plurality of defined bores that are configured to deliver said combustion gas from said interior of said slotted liner to an area of the hydrocarbon reservoir surrounding said second well.

13. The method according to claim 12, wherein said second well further comprising a combustor assembly packer configured to seal an area of said interior of said slotted liner adjacent said igniter.

14. The method according to claim 13, wherein said fuel tubing is a plurality of fuel tubing sections fitted together by a fuel tubing connection joint, and said oxidant tubing is a plurality of oxidant tubing sections fitted together by a oxidant tubing connection joint.

15. The method according to claim 9, wherein said third well is configured to produce at least some of said combustion gas, in combination with injection of said vaporizable fluid.

16. The method according to claim 15, wherein said third well is configured to produce said at least some of said combustion gas from a heel section of said third well through a separate completion, and to inject said vaporizable fluid into and along a remaining section of said third well.

17. The method according to claim 9, wherein said vaporizing of said vaporizable fluid forms a gas chamber toward a top of the hydrocarbon reservoir.

18. The method according to claim 9, further comprising the step of controlling a gas chamber pressure in said gas chamber by producing at least some of said combustion gas from the top of the hydrocarbon reservoir.

* * * * *